US007052531B2

(12) United States Patent
Kishioka

(10) Patent No.: US 7,052,531 B2
(45) Date of Patent: May 30, 2006

(54) LOCAL CLEANING SYSTEM FOR CONSTRUCTING CLEAN SHIELDED SPACE WITH NO NEED FOR DEDICATED PARTITION WALL, USING CHARGED AIR SHOWER UNIT PROVIDING ION WIND AND LOCAL EXHAUST DEVICE

(76) Inventor: Takashi Kishioka, 3-20, 2 chome, Dairyo, Sumiyoshi-ku, Osaka-shi, Osaka-fu (JP)

( * ) Notice: Subject to any disclaimer, the term of this patent is extended or adjusted under 35 U.S.C. 154(b) by 212 days.

(21) Appl. No.: 10/405,006

(22) Filed: Mar. 31, 2003

(65) Prior Publication Data

US 2004/0187681 A1 Sep. 30, 2004

(51) Int. Cl.
*B03C 3/40* (2006.01)

(52) U.S. Cl. ..... 96/88; 55/DIG. 29; 96/97

(58) Field of Classification Search ..... 55/DIG. 29, 55/DIG. 36, DIG. 18; 96/97, 88; 95/78
See application file for complete search history.

(56) References Cited

U.S. PATENT DOCUMENTS

| | | | | | |
|---|---|---|---|---|---|
| 3,397,631 | A | * | 8/1968 | Simons | 454/190 |
| 3,505,989 | A | * | 4/1970 | Truhan | 600/21 |
| 3,511,162 | A | * | 5/1970 | Truhan | 454/187 |
| 3,695,001 | A | * | 10/1972 | Watanabe | 95/78 |
| 3,728,866 | A | * | 4/1973 | Layton | 62/126 |
| 3,768,258 | A | * | 10/1973 | Smith et al. | 60/275 |
| 3,776,121 | A | * | 12/1973 | Truhan | 454/187 |
| 3,853,750 | A | * | 12/1974 | Volsy | 209/127.1 |
| 3,879,986 | A | * | 4/1975 | Sehmel | 73/28.04 |
| 5,865,880 | A | * | 2/1999 | Matsui | 96/26 |
| 6,287,368 | B1 | * | 9/2001 | Ilmasti | 96/19 |
| 6,379,427 | B1 | * | 4/2002 | Siess | 95/57 |
| 6,464,754 | B1 | * | 10/2002 | Ford | 95/26 |
| 6,506,238 | B1 | * | 1/2003 | Endo | 96/79 |
| 6,620,224 | B1 | * | 9/2003 | Sato | 96/83 |
| 2002/0159215 | A1 | * | 10/2002 | Siess | 361/232 |

FOREIGN PATENT DOCUMENTS

| | | | | |
|---|---|---|---|---|
| JP | 56-78645 | * | 6/1981 | 96/97 |

* cited by examiner

*Primary Examiner*—Richard L. Chiesa
(74) *Attorney, Agent, or Firm*—Ostrolenk, Faber, Gerb & Soffen, LLP

(57) ABSTRACT

A local cleaning system which uses a charged air shower unit for forming a shield curtain by means of an ion wind, and a local exhaust device for exhausting the air containing dirt and dust settled down on the floor by the ion wind to construct a clean shielded space with no need for a dedicated partition wall. With this local cleaning system, the charged air shower unit provides negative charges for gas molecules, and dirt and dust, floating microorganisms, odor constituents, and other foreign matters, for electrically neutralizing them, and leads the gas molecules and foreign matters which have lost the charges and which Brownian motion is suppressed, by means of the ion wind for effectively sucking them into the local exhaust device or air cleaner. Because a charged air curtain including an invisible ion wind provides a shield plane, a clean shielded space can be constructed with no need for a dedicated partition wall.

12 Claims, 5 Drawing Sheets

LOCAL CLEANING SYSTEM FOR CONSTRUCTING CLEAN SHIELDED SPACE WITH NO NEED FOR DEDICATED PARTITION WALL, USING CHARGED AIR SHOWER UNIT PROVIDING ION WIND AND LOCAL EXHAUST DEVICE

FIELD

The present invention relates to a local cleaning system which can construct a clean shielded space with no need for a dedicated partition wall, and more particularly, to a local cleaning system which electrically neutralizes dirt and dust, microorganisms, odor constituents, and other foreign matters in an ion wind, suppresses the Brownian motion, utilizes gravity for causing them to settle down onto the floor, forms an ion wind region in the form of a curtain, and provides the curtain-like region as a shield curtain.

BACKGROUND

General shielded space construction systems which have been conventionally known can be divided into two broad general categories: physical shield system and air curtain. The physical shield system partitions the space with a shield wall such as a plate glass, a partition, and a plastic curtain, and uses a local exhaust device for cleaning the space physically shielded from the outside space with the shield wall. The air curtain system uses a blower fan to produce a forced draft for creating a curtain-like air flow, and by utilizing the curtain-like air flow as a shield plane, prevents the air from being moved from the space on one side of the shield plane to that on the other, thus blocking invasion of foreign matters from the space on the one side of the shield plane to that on the other, and shielding the space on the other side from that on the one side.

Of the two different systems, the physical shield system cannot be adopted for such a facility as that with which a belt conveyor crosses the shield plane, and if it could be used, the shield wall would provide an obstacle for operation, impairing the workability in the shielded space. The shielded space construction system which combines shield walls is not suitable for shielding in a narrow area and a complicated facility.

The air curtain system generates an air flow by applying a pressure to the air, however, a vortex flow is produced behind the air flow. Thus, with the air curtain system, invasion of foreign matters is promoted or a phenomenon of diffusion of foreign matters is caused, resulting from such vortex flow, which makes it difficult to obtain a satisfactory shielding effect.

Thus, the physical shield system provides a poor workability, and the air curtain system gives a poor effect of shield, therefore, the conventional shielded space construction systems present a problem on the workability or shielding effect.

On the other hand, as a device to remove the dirt and dust in the air, a dust collector which generates an ion wind, uses that ion wind to give negative charges to the dust particles in the air, and collects the negatively charged dust particles on the anode is known. With such a dust collector, the reach of the ion wind is as short as 30 cm, the ion wind being supplied only for a local narrow space.

Then, the purpose of the present invention is to provide an air shield plane forming method, a shielded space forming method and device, a local cleaning method and device, and a local cleaning system which are excellent in workability, and yet provide a high shielding effect.

SUMMARY OF THE INVENTION

The present invention provides an air shield plane forming method, wherein an ion wind descending toward a floor is generated by a negative ion generating section in upper section; the region in which the ion wind exists is made curtain-like; the curtain-like ion wind region is used as a shield plane; and the shield plane intersects the top of the floor at right angles or is inclined with respect to the top of the floor.

The present invention provides a method for forming a shielded space with which movement of air from external space is practically blocked at shield plane, wherein a curtain-like ion wind region is formed in the air, and the curtain-like ion wind region is used as at least a part of said shield plane.

The present invention provides a local cleaning method for forming a clean shielded space with which movement of air from external space is practically blocked at shield plane, wherein a curtain-like ion wind region is formed in the air; the curtain-like ion wind region is used as at least a part of said shield plane; and the air in the shielded space is cleaned by air cleaning means.

The present invention provides a shielded space forming device, comprising ion wind generating means which blows an ion wind downward, the ion wind existing in a curtain-like ion wind region, and the curtain-like ion wind region being used as at least one shield plane.

The present invention provides a device for forming a shielded space which is shielded from external air at shield plane, wherein a curtain-like ion wind region is formed in the air, and the curtain-like ion wind region is used as at least one shield plane.

The present invention provides a local cleaning device for forming a clean shielded space which is shielded from external air at shield plane, comprising ion wind generating means for forming a curtain-like ion wind region in the air, and air cleaning means for cleaning the air in the shielded apace with which the curtain-like ion wind region is used as at least one shield plane.

The present invention provides a local cleaning system constructing a shielded space with which movement of air from external space is practically blocked at boundary region, comprising:

a charged air shower unit which forms a curtain-like ion wind region, and a local exhaust device receiving the flowing air attributed to the ion wind, at least one said boundary region being comprised of said ion wind region.

The present invention provides another local cleaning system, wherein said charged air shower unit comprises an ion wind blowing direction adjusting mechanism for changing the direction of blow of said ion wind.

The present invention provides still another local cleaning system, wherein said charged air shower unit comprises a discharge electrode acting as cathode; two plate-like anodes which surfaces are opposed with a spacing being given; and an insulating frame which insulates the discharge electrode from the anodes, and maintains the relative positions of the discharge electrode and the anodes, said anode being in contact with said frame only at the edge portions, If the region of said anode that is on the back thereof and between said edge portions is called a rear flat plate region, the rear flat plate region being opposed to said frame with an insulating space being given therebetween, and said rear flat plate region and the region of said frame that is opposed to the rear flat plate region are connected with a stud bolt.

The present invention provides still another local cleaning system, wherein said discharge electrode is fixed on a conductive discharge electrode supporting member which is provided at the top of said frame, through an insulating sheet, a slot for prevention of creeping discharge being formed in the portion of said frame where said discharge electrode supporting member is fixed, said slot being penetrated from the discharge space for said discharge electrode to the space outside said frame, and being provided in the frame at the middle of said discharge electrode supporting member and said anode.

The present invention provides still another local cleaning system, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

The charged air shower unit in the above stated local cleaning system according to the present invention blows a curtain-like ion wind descending toward the floor in the plane to be provided with a shield, forming a shield plane with an ion wind curtain. Almost all of the dirt and dust particles, microorganisms, odor constituents, and other foreign matters in the air are positively charged. When a positively charged foreign matter is contacted with an ion wind, it is electrically neutralized. On both sides of the curtain-like ion wind, the internal air in the shielded space that is to be cleaned and the external air outside the shielded space are provided, and when both are contacted with the curtain-like ion wind, the foreign matters contained in the internal air and the external air are electrically neutralized. The Brownian motion of the electrically neutralized foreign matters is suppressed. The foreign matters which Brownian motion is suppressed start to be dropped by gravity toward the floor. Then, the air on both sides of the curtain-like ion wind descends toward the floor together with the curtain-like ion wind, while containing the electrically neutralized foreign matters. Thus, the local cleaning system according to the present invention blows a curtain-like ion wind toward the floor, causing the air contacted with the curtain-like ion wind to descend, which results in generation of a descending air flow (draft) comprising a curtain-like ion wind and the air on both sides thereof. Because such descending air flow is created, there occurs no movement of air from the external space to the internal one or vice versa. Therefore, the foreign matters in the external space are blocked by the curtain-like ion wind, being prevented from entering the shielded space. Thus, the local cleaning system according to the present invention has successfully configured a boundary plane between the shielded space and the external space with the region of an invisible curtain-like ion wind.

The charged air shower unit thereof is an ion generating device, comprising a discharge electrode, an anode, and a frame. The frame is a nonconductive cabinet which holds both electrodes, insulating them from each other. The discharge electrode is the cathode, being disposed at center of the suction port, and made of a metal, such as stainless steel. The anode comprises two plate-like conductors whose surfaces are parallel with each other, being opposed to each other with a definite spacing. The anode comprising two plate-like conductors opposed to each other with a definite spacing is disposed such that the middle point in the clearance therebetween is located under the discharge electrode. The relative positions of the discharge electrode and the anode are maintained by the frame.

A high voltage is applied across the discharge electrode and the anode such that a corona discharge is caused at the discharge electrode. The corona discharge causes electrons to be emitted at the discharge electrode, creating a plasma around the discharge electrode. The electrons discharged at the discharge electrode, and the electrons and negatively charged ions in the plasma are subjected to the Coulomb force by the electric field between the discharge electrode and the anode. The accelerated electrons and negatively charged ions are contacted with the air, changing the oxygen and hydrogen molecules in the air into negatively charged ions. Those electrons and negatively charged ions are further accelerated by the Coulomb force due to the electric field. A part of the accelerated electrons and negatively charged ions is collide with the anode to be neutralized. The remainder of the accelerated electrons and negatively charged ions is passed through the clearance between the anode plate-like conductors, being caused to flow downward through the ion wind discharge port. The flow of the electrons and ions which are thus formed and passed through the clearance between the anode plate-like conductors is the ion wind.

With this charged air shower unit, the anode electrode comprises two plate-like conductors which are opposed to each other, therefore the ion wind formed provides a curtain-like configuration, having a small thickness and a large breadth. The curtain plane in the curtain-like ion wind matches to the middle plane in the clearance between the two plate-like conductors in the anode. The curtain-like ion wind is started in the vicinity of the lower edges of the two plate-like conductors, and is extended downward to the floor through the ion wind discharge port. As stated above, the positively charged molecules, dirt and dust particles, and the like in the air which have been contacted with the air are neutralized and descend by gravity. Then, this charged air shower unit blows the ion wind downward, causing the direction of the ion wind to match to the direction of movement of the descending neutralized molecules and the like for extending the length of the shield curtain provided by the ion wind. Therefore, the orientation of the charged air shower unit is generally set such that the curtain-like ion wind is at right angles to the floor or slightly inclined. The ion wind discharge port of the charged air shower unit is disposed at the upper edge of the shield curtain to be formed. By causing the ion wind discharge port to match to the upper edge of the shield curtain, a shield curtain extending from the upper edge of a desired shield boundary to the floor can be formed.

The breadth of the curtain-like ion wind may be increased as much as desired by providing two plate-like conductors constituting the anode electrode that have a sufficiently large breadth, and disposing a plurality of discharge electrodes linearly at intervals along the horizontal direction of the plate-like conductors above the clearance between the plate-like conductors.

As stated above, with the method and device according to the present invention, a flow of ion wind from top to bottom is generated, and the dirt and dust, microorganisms, odor constituents, and other foreign matters contained in both spaces which are separated by that flow of ion wind are led by the draft comprising the flow of ion wind, being caused to descend downward. The dirt and dust, microorganisms, odor constituents, and other foreign matters in the spaces which are separated by the ion wind are gradually settled down, dropped, and caught by the floor. Then by forming an ion wind curtain at least one plane of the space to be shielded for cleaning, the shielded space is gradually cleaned. The air in the external space that would flow into the shielded space is blocked by the invisible shield plane of the ion wind (the curtain-like ion wind region), and the dirt and dust, microorganisms, odor constituents, and other foreign matters contained in the air in the external space are led by the draft and settled down on the same principle, being prevented from flowing into the shielded space.

With the method and device according to the present invention that use the above-stated curtain-like ion wind, there is no need for providing a dedicated shield wall, unlike the physical shield system, which partitions the space with a shield wall, thus a barrier-free space can be created. Also, unlike the air curtain system, which uses a blower fan to produce air blast for creating a curtain-like air flow, and employs the curtain-like air flow as the shield plane, the method and device according to the present invention creates a shield plane by using a curtain-like ion wind, which will not stir the air, assuring a high shielding effect.

As stated above, with the local cleaning system according to the present invention, the direction of the ion wind formed by the charged air shower unit is at right angles to the floor or slightly inclined. By providing the charged air shower unit with an ion wind blowing direction adjusting mechanism which allows the direction of blowing the ion wind to be changed by changing the orientation of the ion generating section itself comprising the anode and the frame, the inclination angle formed by the direction of the ion wind and the floor can be freely established. This ion wind blowing direction adjusting mechanism changes the orientation of the ion generating means itself, eliminating the need for causing the ion wind to strike against a deflection plate. By adopting the ion wind blowing direction adjusting mechanism, the need for causing the ion wind to strike against a deflection plate is eliminated, which assures that no free electrons are lost by the deflection plate, therefore, the direction of the ion wind can be freely adjusted and the need for shortening the length of the ion wind will not arise.

In addition, because the ion wind blowing direction adjusting mechanism allows the direction of the ion wind to be adjusted to a desired angle, the disposition of the local exhaust device and the flow of the ion wind in the space to be shielded can be selected optimally, and thus the ion wind can be effectively led to the local exhaust device, which allows effective cleaning the shielded space.

On the discharge electrode and the anode in the ion generating section, the dirt and dust and other foreign matters in the passing air are deposited due to the electrostatic adsorption power acting between them. When the amount of foreign matters deposited on the electrode is increased, the conductivity between the discharge electrode and the anode is also increased, which may result in an arc discharge or a creeping discharge being caused. If an arc discharge or a creeping discharge is caused, the corona discharge will disappear, resulting in the ion wind being shut off.

With the local cleaning system according to the present invention, a through-slot having a definite length and width is provided in a portion of the frame between the discharge electrode and the anode for suppressing the deposition of foreign matters and thus suppressing occurrence of a creeping discharge. The construction which places a through-slot having a definite length and width between the discharge electrode and the anode inserts a dielectric of air, on which no foreign matters can be deposited, in the frame between the discharge electrode and the anode, and thus suppress deposition of foreign matters.

With the local cleaning system according to the present invention, at least one region of the shield plane in the shielded space is configured by using the curtain-like ion wind generated in the ion generating section. For example, if the shielded space forms a hexahedron, and the shield plane comprises six planes of the top and bottom, and the four sides, one plane may be configured by using the curtain-like ion wind, and the other planes may be configured with the ceiling and floor, and the walls. The air containing the foreign matters settled down in the vicinity of the floor by the ion wind flowing toward the floor from top can be exhausted by the local exhaust device, and by returning the exhausted air to the shielded space, the shielded space can be cleaned without the shielded space being negatively pressurized.

When a shielded space is provided in a portion of a space where the ceiling is high, as is the case with a plant in which a crane is installed, using the ceiling as a shield plane will result in the height of the side of the shielded space exceeding the reach of the ion wind produced by the local cleaning system according to the present invention. Then, the shield plane providing the ceiling plane of the shielded space is also configured by using the curtain-like ion wind according to the present invention. The shield plane by the curtain-like ion wind may not intersect with the floor at right angles, but if it is in parallelism with the floor, the reach of the ion wind is small, which is not practical. Then, with the local cleaning system according to the present invention, the curtain-like ion wind for shielding the ceiling plane is inclined (at 30 degrees, for example) with respect to the floor such that the curtain-like ion wind is caused to flow slantwise with respect to the floor.

With the local cleaning system according to the present invention, a local exhaust device suited for the application must be provided for cleaning the shielded space, and at the same time, the flow of the ion wind must be produced such that the foreign matters settled down in the vicinity of the floor by the curtain-like ion wind are effectively led to the local exhaust device. The type and installation location of the local exhaust device must be selected to suit to the configuration and application of the shielded space. The ion wind is caused to flow from top to bottom as a general rule, thus installing the local exhaust device at the bottom provides more efficient catching of the foreign matters.

In addition, the local cleaning system according to the present invention may be utilized as a smoke dividing facility. In this case, the smoke is heated, having a tendency of rising, therefore increasing the pressure of the downward ion wind will impede catching the smoke. Then when the local cleaning system according to the present invention is used as a smoke dividing facility, a wall-type air cleaner to be attached to the side wall top or an air cleaner to be built in at the ceiling must be selected as a local exhaust facility. The suction power of the air cleaner deflects the direction of the ion wind such that the ion wind is directed toward the air cleaner before it reaches the floor. The air cleaner sucks the smoke caused to descend by the ion wind and the sub-flow smoke together with the ion wind. With this configuration, the flow of the ion wind and that produced by the suction power of the air cleaner are combined with each other for cleverly catching the smoke and the sub-flow smoke. In this case, inclining the direction of the ion wind slightly toward the suction port of the local exhaust device and weakening the pressure of the ion wind as compared to the suction power of the local exhaust device will provide more efficient catching.

BRIEF DESCRIPTION OF THE DRAWINGS

The foregoing and other purposes and features of the invention will become apparent from the following description of the embodiments of the invention with reference to the accompanying drawings, in which.

DETAILED DESCRIPTION

Figure 1:
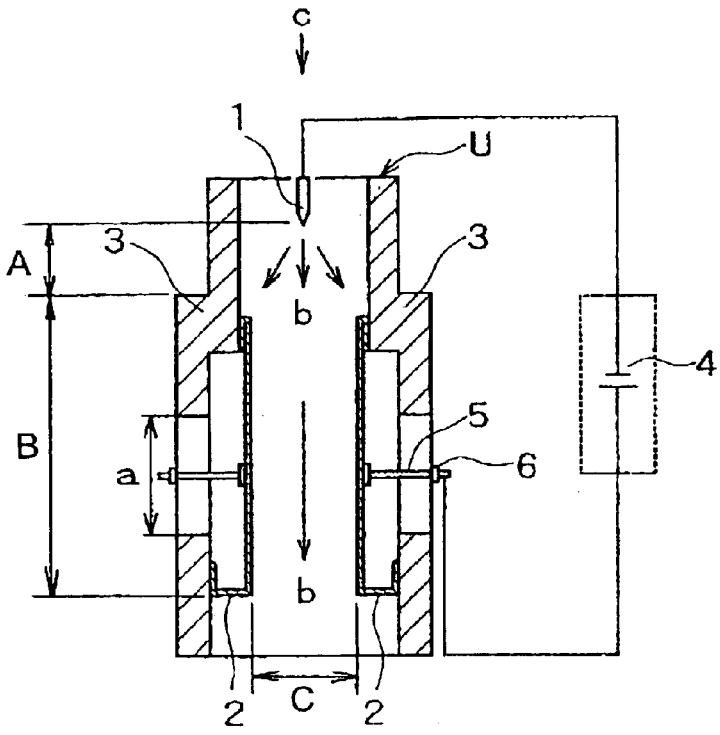
FIG. 1 is a schematic view showing an ion generating section of a charged air shower unit.

First, the ion generating section of a charged air shower unit in the local cleaning system according to the present invention will be outlined. As shown in FIG. 1, the ion generating section of a charged air shower unit U comprises a discharge electrode 1, which is the cathode for emitting electrons, an anode 2 for collecting the electrons, and a unit frame 3 (equivalent to the frame as mentioned above) for fixing the discharge electrode 1 and the anode 2 as well as insulating them from each other.

The anode 2 can be slid in the range of "a" by means of a stud bolt 5 and a nut 6 for making fine adjustment of the distance "A" between the discharge electrode 1 and the anode 2.

The anode 2 is grounded and a high negative voltage (−20 kV, for example) is applied to the discharge electrode 1.

The positive output terminal of a DC power supply 4 is connected to both plate-like conductors in the anode 2, however, in FIG. 1, the connection line to one of the plate-like conductors in the anode 2 is omitted to be shown. When an appropriate high voltage is applied across the discharge electrode 1 and the anode 2 from the DC power supply 4, dielectric breakdown is caused in the space between the discharge electrode 1 and the anode 2. resulting in occurrence of a corona discharge between the discharge electrode 1 and the anode 2, the corona discharge involving plasma generation, with a large quantity of electrons "b" being emitted from the tip of the discharge electrode 1.

Between the discharge electrode 1 and the anode 2, the plasma and the electrons emitted from the discharge electrode 1 provide negative charges for the molecules constituting gas "c", resulting in negative ions being produced. The electrons and the negative ions between the discharge electrode 1 and the anode 2 are subjected to the Coulomb force by the electric field between the discharge electrode 1 and the anode 2. A part of the electrons and the negative ions between the discharge electrode 1 and the anode 2 subjected to the Coulomb force is collided against the anode 2. The electrons collided against the anode 2 are taken into the anode 2, and the negative ions collided against the anode 2 lose the charges to be electrically neutralized. The remainder of the electrons and the negative ions subjected to the Coulomb force are discharged toward the ion wind discharge port. The ion wind discharge port is an opening formed under the anode 2. The voltage and the spacing between the electrodes are set such that the negative charges given to the molecules constituting the gas "c" are discharged at a maximum mass transfer rate from the ion wind discharge port. A number of negative ions of molecules constituting the gas "c" and electrons "b" are collected by the anode 2 to disappear, but negative ions of molecules constituting the gas "c" and electrons "b" which have a mass transfer rate higher than the collection rate are saved from disappearing, and accelerated to be discharged toward the ion wind discharge port.

Figure 2:
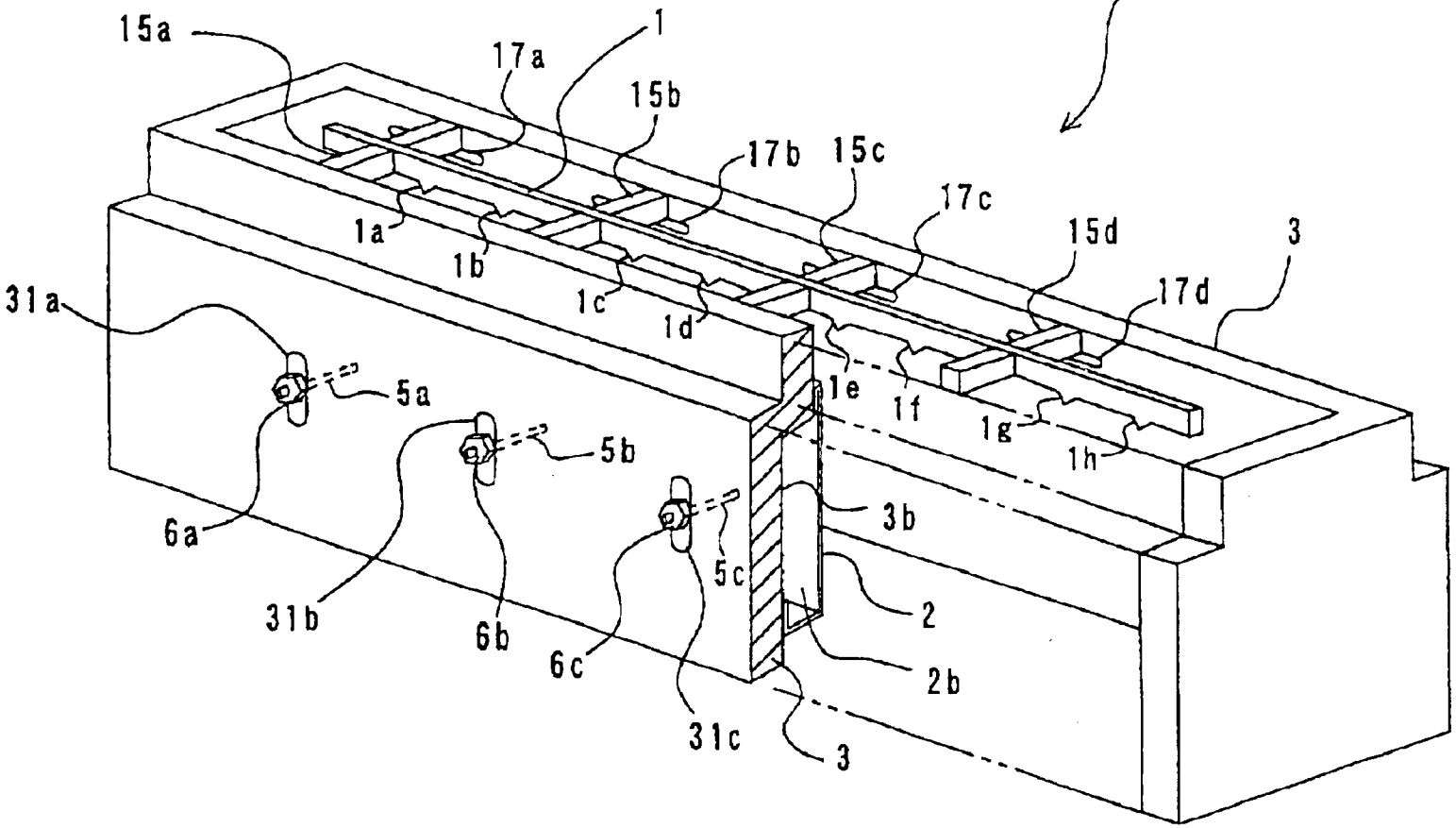
FIG. 2 is a partially cutaway schematic view in perspective of an ion generating section of a charged air shower unit.
Figure 4:
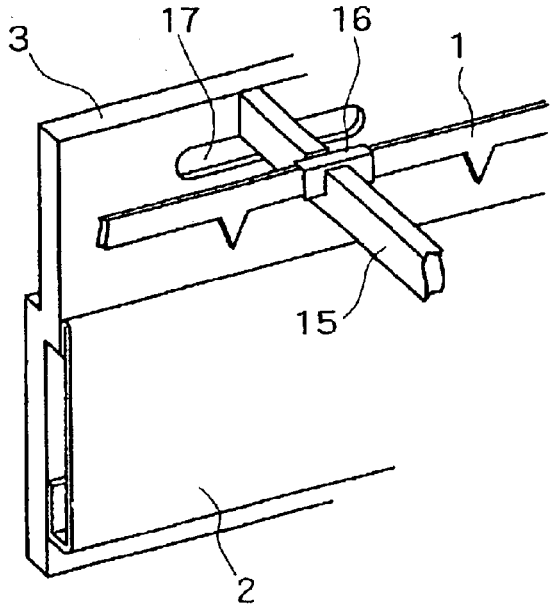
FIG. 4 is a schematic view showing a creeping discharge prevention mechanism.

Next, with reference to FIG. 2, the construction for connecting the anode 2 to the unit frame 3 will be described. The discharge electrode 1 is made of a metallic material, being supported by discharge electrode supporting members 15*a*, 15*b*, 15*c*, and 15*d*, and fixed to the unit frame 3. Between the discharge electrode 1 and the respective electrode supporting members 15*a*, 15*b*, 15*c*, and 15*d*, an insulating sheet 16 as shown in FIG. 4 is provided, but the insulating sheet 16 is omitted to be shown in FIG. 4. The discharge electrode 1 is provided with acute angle projections 1*a*, 1*b*, 1*c*, 1*d*, 1*e*, 1*f*, 1*g*, and 1*h*. A corona discharge is caused at the respective tips of the acute angle projections 1*a*, 1*b*, 1*c*, 1*d*, 1*e*, 1*f*, 1*g*, and 1*h*. The anode 2 comprises two plate-like conductors which surfaces are opposed to each other with a spacing C, having a length of B along the vertical direction. In FIG. 2, to avoid complication of drawing, only one of the plate-like conductors in the anode 2 is shown, the other of the plate-like conductors in the anode 2 being omitted to be shown. The unit frame 3, which is made of an insulating plastic material, insulates the discharge electrode 1 and the anode 2 from each other, and maintains the relative position of the discharge electrode 1 and the anode 2. The plate-like conductors in the anode 2 are contacted with the unit frame 3 only in the upper and lower edge portions thereof. If the region of the plate-like conductor of the anode 2 that is on the back thereof and between said edge portions is called a rear flat plate region 2*b*, the rear flat plate region 2*b* is opposed to the unit frame 3 with an insulating space being given therebetween. A rear surface region 3*b* in the unit frame 3 is opposed to the rear flat plate region 2*b* with a clearance being given. The plate-like electrode in the anode 2 and the frame unit 3 are connected to each other with stud bolts 5*a*, 5*b*, and 5*c*. The stud bolts 5*a*, 5*b*, and 5*c* are inserted into oval holes 31*a*, 31*b*, and 31*c*, respectively. One end of the respective stud bolts 5*a*, 5*b*, and 5*c* are fixed to the rear flat plate region 2*b*, while the other end of the respective stud bolts 5*a*, 5*b*, and 5*c* are engaged with a nut 6*a*, 6*b*, or 6*c*. By tightening the nuts 6*a*, 6*b*, and 6*c* on the respective stud bolts 5*a*, 5*b*, and 5*c*, the plate-like conductors in the anode 2 are fixed to the unit frame 3.

Here, by assuming that there is no clearance between the rear flat plate region 2*b* in the anode 2 and the rear surface region 3*b* in the unit frame 3, the rear flat plate region 2*b* being tightly contacted with the rear surface region 3*b*, a creeping discharge being easily caused with such assumed construction will be described. The anode 2 is grounded, and a high negative voltage is applied to the discharge electrode 1, therefore, electrons and negative ions are adsorbed onto the anode 2. If the high voltage is continued for a while, a number of dirt and dust particles negatively charged by the electrons and negative ions are deposited on the surface of the anode 2, and the amount of dirt and dust is increased in proportion to the time period of application of the high voltage. Because the dirt and dust are negatively charged, the rear flat surface region 2*b* in the anode 2 is negatively charged by the electrostatic induction, therefore, the rear surface region 3*b* in the unit frame 3 is positively charged by the electrostatic induction. In this case, the front surface of the unit frame 3 is negatively charged by the polarization of the unit frame 3. The dirt and dust particles floating in the air are positively charged, and thus they are deposited on the front surface of the unit frame 3. The amount of dirt and dust deposited on the front surface of the unit frame 3 is increased in proportion to the time period of application of the high voltage, and the layer of dirt and dust finally reaches the discharge electrode 1. Because a high voltage is applied to the discharge electrode 1, a creeping discharge is caused across the discharge electrode 1 and the anode 2. The time period from the moment when the operation is started to that when the creeping discharge is caused is as short as one week, which provides an obstacle for practical use.

With a construction as shown in FIG. 1 and FIG. 2, a clearance is provided between the rear flat plate region in the anode 2 and the rear surface region 3*b* in the unit frame 3. In this case, only the edge portions of the plate-like conductor in the anode 2 are contacted with the unit frame 3, and only with the edge regions, the same phenomenon as that described by assuming the construction having no clearance will appear. However, in the regions providing a clearance, the amount of positive charges developed in the rear surface region of the unit frame 3 by the electrostatic induction is small, thus the amount of negative charges appearing on the front surface of the unit frame 3 is also small. Then, with the construction as shown in FIG. 1 and FIG. 2, the rate at which the amount of dirt and dust deposited on the front surface of the unit frame 3 is extremely low, as compared to that for the construction providing no clearance, and thus if the dirt and dust deposited on the front surface of the unit frame 3 is not removed over a time period of one month or longer, the creeping discharge will not occur.

Figure 3:
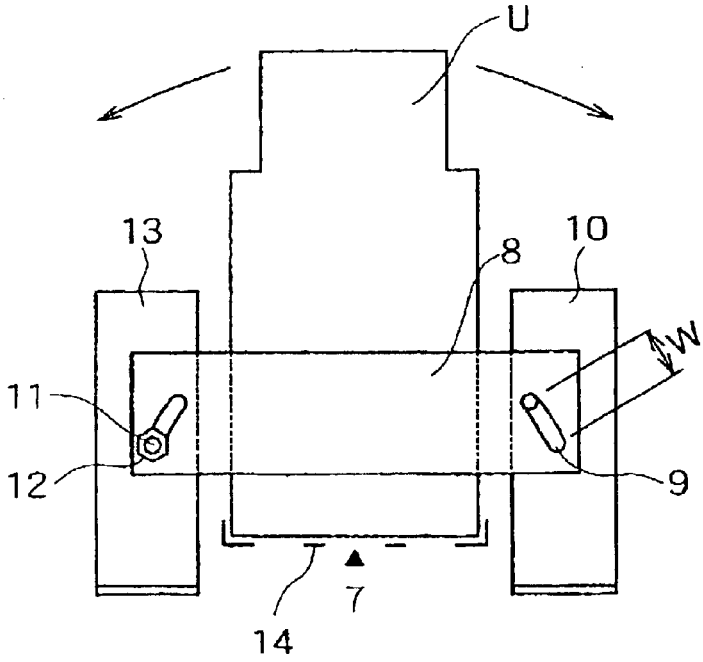
FIG. 3 is a schematic view showing a mode of operation of an ion wind blowing direction adjusting mechanism.

Next, with reference to FIG. 3, the operation of ion wind blowing direction adjusting mechanism in the charged air shower unit U will be described. As shown in FIG. 3, the charged air shower unit U is configured such that a fixing guide 8 can be turned in a clockwise or counterclockwise direction within the range of W around a base point 7. The fixing guide 8 is installed such that it is supported at the right and left portions thereof with a fixing guide metal fitting 10 positioned with a fixing pin 9, and a fixing guide metal fitting 13 which uses a combination of a stud bolt 11 with a tightening nut 12 instead of the fixing pin 9, being constructed such that it can be inclined in a clockwise or counterclockwise direction around the base point 7, and fixed at any desired angle.

The above mechanism to incline the charged air shower unit U itself for changing the wind direction will not cause electrons in the ion wind to be lost and thus will not attenuate the ion wind when changing the direction of the ion wind. The direction of the ion wind can be adjusted by causing the ion wind to strike against a guide vane, and changing the orientation of the guide vane, however, with any mechanism which changes the wind direction by means of a guide vane, electrons are lost, which promotes the attenuation of the ion wind, when the ion wind is contacted with the guide vane, of whichever material the guide vane is made, metallic or plastic.

Further, at the ion wind discharge port in the charged air shower unit U, a protection cover 14 made of metal is provided as a measure for safety, such that, if the human body accidentally touches the inside anode, no electric shock will be caused.

Here is a description about a measure against creeping discharge which can occur in the ion generating section. The charged air shower unit U and many other products utilizing ions take advantage of static electricity. With a product utilizing ions, dirt and dust deposit on the electrodes and the surrounding frame due to the electrostatic adsorption, resulting in a creeping discharge through dirt and dust, which often prevents the corona discharge from being given. Moisture adsorption of dirt and dust further increases the possibility of occurrence of the creeping discharge.

With reference to FIG. 4, a construction to prevent this phenomenon will be described. Between the discharge electrode 1 and the electrode supporting member 15 supporting the discharge electrode 1, an insulating sheet 16 is provided. The insulating sheet 16 reliably insulates the discharge electrode 1 and the electrode supporting member 15 from each other.

With the charged air shower unit U according to the present invention as shown in FIG. 1, the unit frame 3 is made of a plastic material having a high nonconductivity, being intended to provide a complete insulation between the discharge electrode land the anode 2. However, if a complete insulation is provided, it is not easy to prevent occurrence of creeping discharge between the discharge electrode 1 and the anode 2 through the unit frame 3 due to the deposition of dirt and dust. With the charged air shower unit U according to the present invention, occurrence of creeping discharge is prevented by providing a slot in the unit frame where the discharge electrode supporting member 15 is anchored. The slot 17 provides a boundary for electrical separation between the anode 2 and the discharge electrode 1. By providing this slot 17 as a separation boundary, the unit frame 3 can be completely separated from the discharge electrode supporting member 15, which leads to complete separation between the anode 2 and the discharge electrode 1. Now, there is no possibility of creeping discharge through the slot 17 occurring.

Next, exemplary embodiments of the local cleaning system which utilizes a charged air shower unit U comprising said functions, for creating a desired clean shielded space with no need for providing a dedicated partition will be described in sequence.

Figure 5:
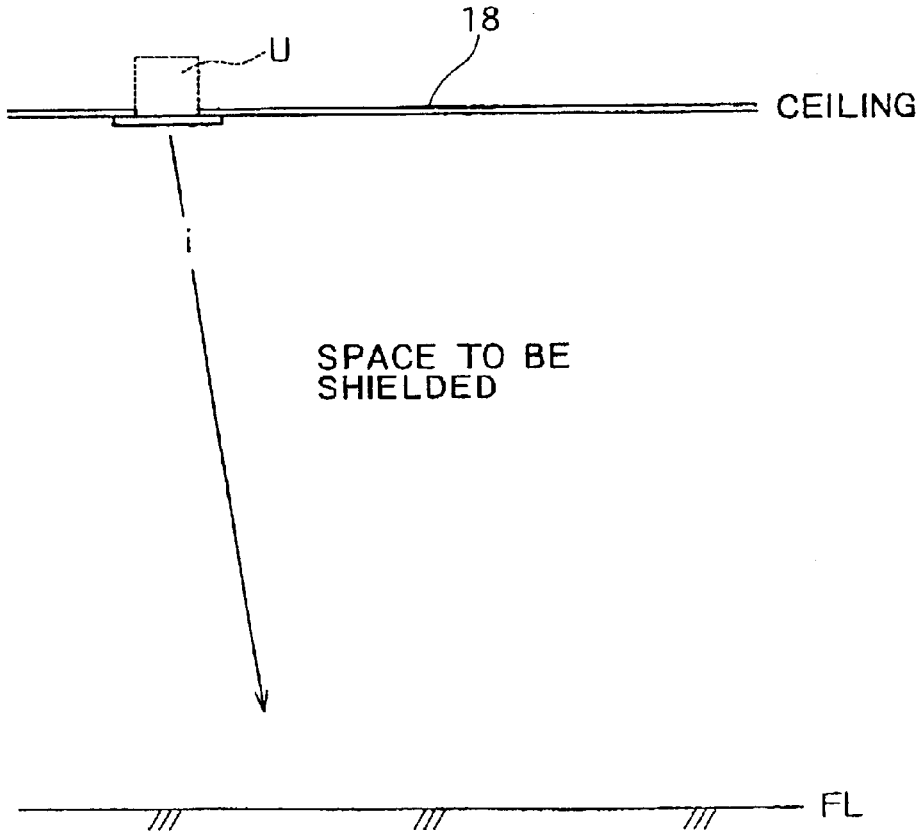
FIG. 5 is a schematic side view showing an embodiment wherein a shield is created in one plane with no need for a dedicated partition wall.

An exemplary embodiment as illustrated in FIG. 5 provides a method for constructing a shielded clean space by creating a shield in one plane of the space to be shielded by means of a charged air shower unit U. A ceiling 18 of the space to be shielded is provided with an opening, and a charged air shower unit U is appropriately embedded in the opening. Then, the orientation of the ion wind blowing port of the embedded air shower unit is slightly adjusted toward a desired clean space in order to discharge the flow of an ion wind "i" in the directions lightly inclined toward the clean space. In this case, a local exhaust device or an air cleaner is provided for the clean space. The air exhausted by the local exhaust device or further cleaned by the air cleaner is returned to the clean space. By returning the exhausted or further cleaned air to the clean space, the clean space can be prevented from being negatively pressurized.

When the dirt and dust in the room are passed through the charged air shower unit U, they lose the charges, being carried by the ion wind "i" to be dropped, settled onto, and trapped by the floor. The dirt and dust particles, and molecular substances which are collided with the shield plane provided by the ion wind "i" also lose the charges by adsorbing diffused electrons, being led to and trapped by the floor in the same manner, and thus prevented from returning to the clean space. The cleanliness of the clean space is gradually increased as the local exhaust device or the air cleaner operates for ventilation.

Figure 6:
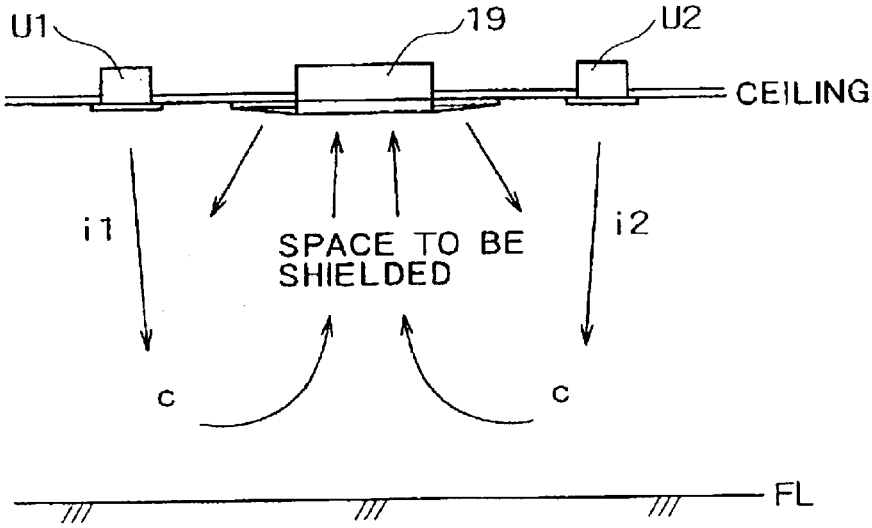
FIG. 6 is a schematic side view showing an embodiment wherein a shield is created in two planes with no need for a dedicated partition wall.

An exemplary embodiment as illustrated in FIG. 6 provides a method for constructing a clean shielded space by creating a shield in two planes of the space to be shielded by means of charged air shower units U1 and U2 as if a clean shielded space is inserted into the original space.

In this case, the ion wind blowing port of the charged air shower unit U1 and the ion wind blowing port of the charged air shower unit U2 are oriented such that the respective ion winds are discharged, the directions thereof being inclined at diametrically opposed angles, and at the middle of the charged air shower unit U1 and the charged air shower unit U2, a built-in type air cleaner 19 is embedded. With the method as illustrated in FIG. 6, the ion winds i1 and i2, and drafts "c" produced by the built-in type air cleaner 19 are encountered to synergetically produce circulating winds for constructing a clean shielded space.

Figure 7:
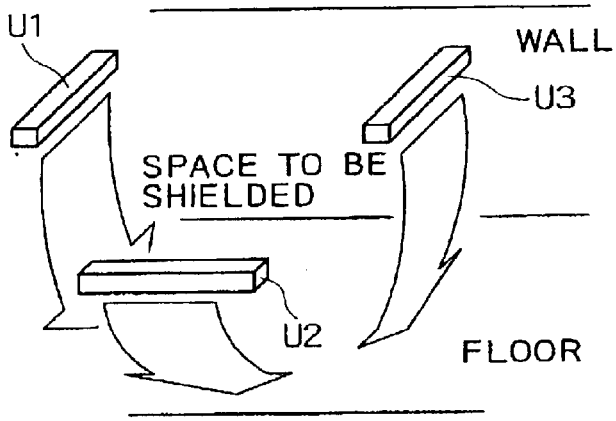
FIG. 7 is a schematic side view showing an embodiment wherein a shield is created in three planes with no need for a dedicated partition wall.

An exemplary embodiment as illustrated in FIG. 7 provides a method for constructing a clean shielded space by creating a shield in three planes of the space to be shielded by means of charged air shower units U1, U2, and U3, and disposing a local exhaust device or a wall type air cleaner on walls; the details of the embodiment being the same as described with reference to FIG. 5 and FIG. 6.

Figure 8:
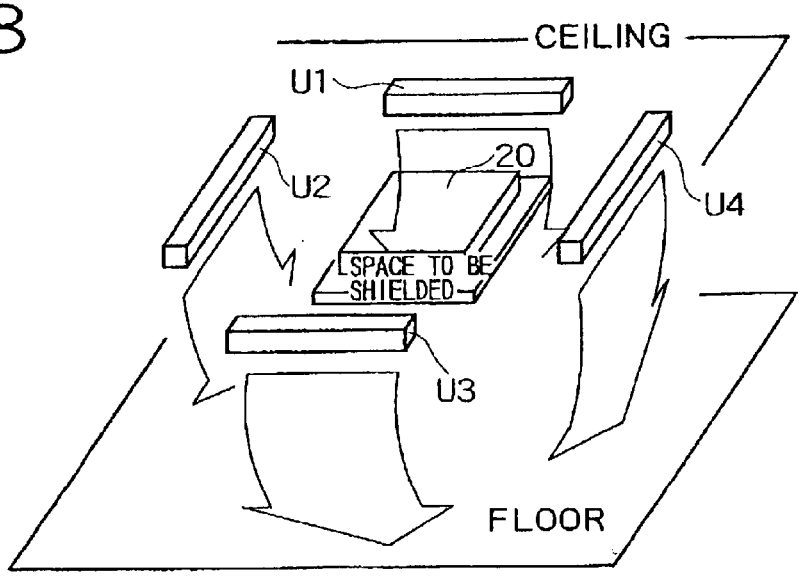
FIG. 8 is a schematic side view showing an embodiment wherein a shield is created in four planes with no need for a dedicated partition wall.

An exemplary embodiment as illustrated in FIG. 8 provides a method for constructing a clean shielded space by creating a shield in four planes of the space to be shielded by means of charged air shower units U1, U2, U3, and U4, and disposing a built-in type air cleaner 20 on the ceiling.

Figure 9:
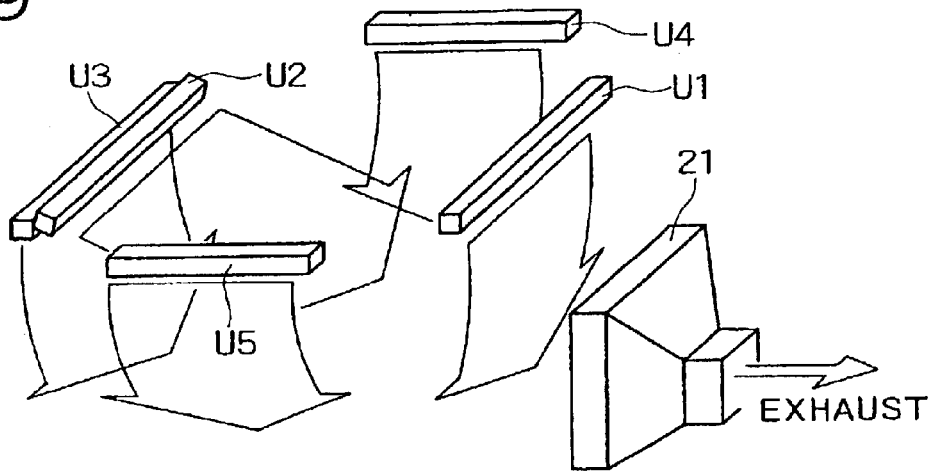
FIG. 9 is a schematic side view showing an embodiment wherein a shield is created in five planes with no need for a dedicated partition wall.

An exemplary embodiment as illustrated in FIG. 9 provides a method for constructing a clean shielded space by creating a shield in four surrounding planes and one ceiling plane of the space to be shielded by means of charged air shower units U1, U2, U3, U4, and U5, and disposing a local exhaust device 21 at the bottom of one shielded vertical plane.

In the exemplary embodiments as illustrated in FIG. 5 to FIG. 8, an existing wall or a ceiling is utilized for creating a shield plane, however, in an exemplary embodiment as illustrated in FIG. 9, all planes except for the floor one are shielded with no existing partitions being utilized.

To do this, the charged air shower unit U1 blows an ion wind toward the suction port of the local exhaust device 21 from askew front thereof at a slight angle, and the charged air shower unit U2, which can create a shield in the ceiling plane, blows an ion wind toward the suction port of the local exhaust device 21 at a slight angle from the horizontal such that the contaminated air is led toward the suction port of the local exhaust device 21. Thus, the ion wind blown by the charged air shower unit U1 is pressed by the ion wind blown from rear top by the charged air shower unit U2, and further accelerated by the suction flow produced by the local exhaust device 21. Then, an overflow is caused at the suction port of the local exhaust device 21, and the overflow, which is not successfully sucked, will leak.

To avoid such phenomenon, a charged air shower unit U2 is provided in a vertical plane in front of the suction port of the local exhaust device 21 in order to blow a vertical ion wind for suppressing a draft which results from the synergetic operations of the charged air shower units U1 and U3, and the local exhaust device 21. By vertically blowing an ion wind in front of the suction port, the draft from the front of the suction port is suppressed, the draft as a result of the synergetic operations being weakened, and the contaminated air can be led to the local exhaust device 21 with no overflow being caused. Further, by vertically shielding at right and left using a charged air shower unit U4 and a charged air shower unit U5, drafts flowing in from right and left for some cause can be suppressed for constructing a more satisfactory clean space.

Figure 10:
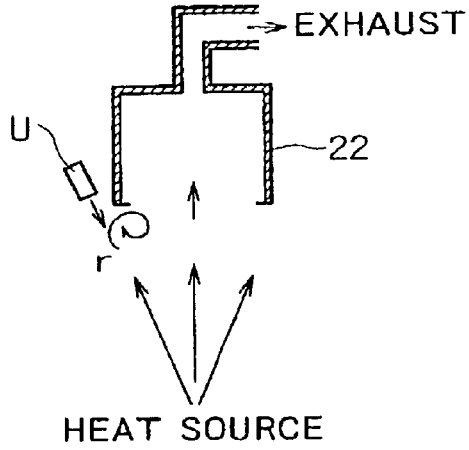
FIG. 10 is a schematic side view showing an embodiment wherein a charged air shower unit is attached to a local exhaust hood for effectively leading the exhaust.

An exemplary embodiment as illustrated in FIG. 10 provides a method for effectively leading the exhaust leaking from a local hood in kitchen by means of a charged air shower unit U. The kitchen exhaust may sometimes involve an air current having a speed exceeding the exhaust rate for the local hood, which results in an unsuccessful suction of the exhaust.

To prevent such phenomenon, the charged air shower unit U blows down an ion wind in the slightly slantwise direction from front of a local hood 22. By doing so, a turbulence "r" which would be generated at the edge of the local hood 22 is suppressed, which allows a draft for effectively leading the exhaust to the local hood 22 to be created.

Figure 11:
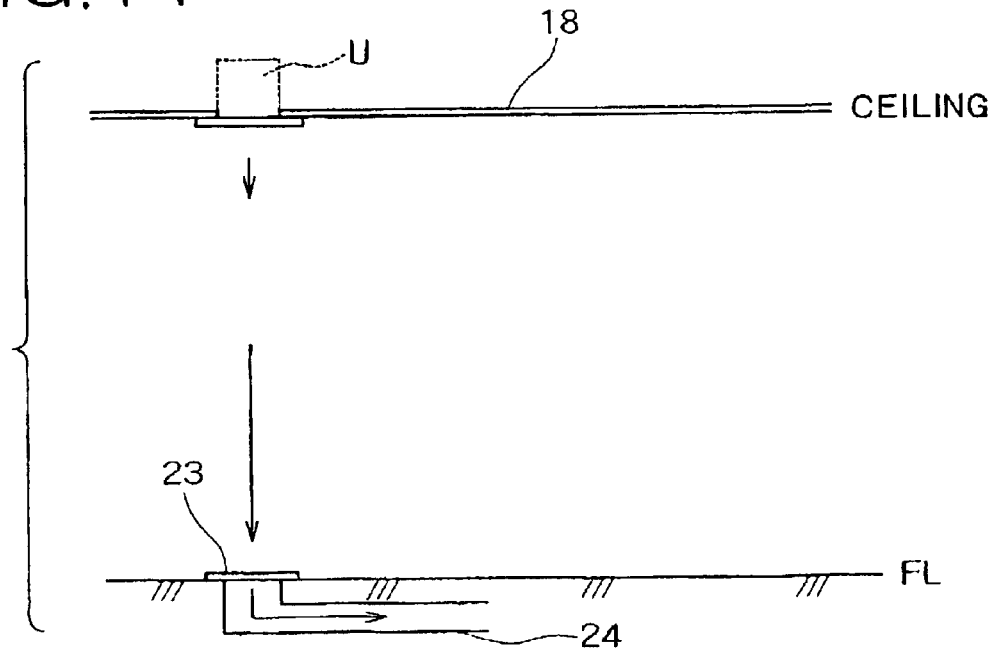
FIG. 11 is a schematic side view showing an embodiment wherein an ion wind is blown in the vertical direction to be exhausted through a local exhaust port in the floor.

An exemplary embodiment as illustrated in FIG. 11 provides a method for shielding foreign matters, dirt and dust, and microorganisms by providing a local exhaust port just under the flow of an ion wind and utilizing the synergetic effects of the ion wind and the suction flow. Specifically, a charged air shower unit U is embedded in the ceiling and just under the charged air shower unit U, a local exhaust port 23 is provided in the floor, an exhaust duct 24 being installed under the floor. This embodiment is combined with a circulating system which utilizes an outdoor exhaust system, a HEPA filter (high efficiency particle air filter) or the like.

By doing this, the ion wind is accelerated by the air flow sucked through the local exhaust port 23, and thus a flow rate which cannot be obtained only with the ion wind is provided, which results in a desired shield effect being well produced even if the power of the air flowing into the shield plane from the outside is high.

As can be seen from the above description of the exemplary embodiments, the system which combines ion winds with a local exhaust device forms a shield plane by allowing gas molecules and particles to adsorb electrons for invalidating the charges, rather than by using air blast to produce a wind pressure, as is the case with other air curtain systems, and utilizing the ion wind for carrying and leading the gas molecules and particles with which the Brownian motion is suppressed, therefore, without the surrounding contaminated air being rolled up, which phenomenon is caused by the turbulence due to the wind pressure, a clean space can be constructed without the need for providing a dedicated partition wall, and such construction of clean space cannot be achieved by any systems other than those according to the present invention, which utilizes the ion wind.

What is claimed is:

1. A local cleaning system constructing a shielded space with which movement of air from external space is practically blocked at boundary region, comprising:

a charged air shower unit which forms a curtain-shaped ion wind region, and a local exhaust device receiving the flowing air attributed to the ion wind, at least one said boundary region being comprised of said ion wind region, wherein said charged air shower unit comprises a discharge electrode acting as cathode; two plate-shaped anodes which surfaces are opposed with a spacing being given; and an insulating frame which insulates the discharge electrode from the anodes, and maintains the relative positions of the discharge electrode and the anodes, said anode being in contact with said frame only at the edge portions, if the region of said anode that is on the back thereof and between said edge portions is called a rear flat plate region, the rear flat plate region being opposed to said frame with an insulating space being given therebetween, and said rear flat plate region and the region of said frame that is opposed to the rear flat plate region are connected with a stud bolt.

2. The local cleaning system as set forth in claim 1, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

3. The local cleaning system as set forth in claim 1, wherein said discharge electrode is fixed on a conductive discharge electrode supporting member which is provided at the top of said frame, through an insulating sheet, a slot for prevention of creeping discharge being formed in the portion of said frame where said discharge electrode supporting member is fixed, said slot being penetrated from the discharge space for said discharge electrode to the space outside said frame, and being provided in the frame at the middle of said discharge electrode supporting member and said anode.

4. The local cleaning system as set forth in claim 3, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

5. A local cleaning system constructing a shielded space with which movement of air from external space is practically blocked at boundary region, comprising:

a charged air shower unit which forms a curtain-shaped ion wind region, and a local exhaust device receiving the flowing air attributed to the ion wind, at least one said boundary region being comprised of said ion wind region, wherein said discharge electrode is fixed on a conductive discharge electrode supporting member which is provided at the top of said frame, through an insulating sheet, a slot for prevention of creeping discharge being formed in the portion of said frame where said discharge electrode supporting member is fixed, said slot being penetrated from the discharge space for said discharge electrode to the space outside said frame, and being provided in the frame at the middle of said discharge electrode supporting member and said anode.

6. The local cleaning system as set forth in claim 5, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

7. A local cleaning system constructing a shielded space with which movement of air from external space is practically blocked at boundary region, comprising:

a charged air shower unit which forms a curtain-shaped ion wind region, and a local exhaust device receiving the flowing air attributed to the ion wind, at least one said boundary region being comprised of said ion wind region, wherein said charged air shower unit comprises an ion wind blowing direction adjusting mechanism for changing the direction of blow of said ion wind, and wherein said charged air shower unit comprises a discharge electrode acting as cathode; two plate-shaped anodes which surfaces are opposed with a spacing being given; and an insulating frame which insulates the discharge electrode from the anodes, and maintains the relative positions of the discharge electrode and the anodes, said anode being in contact with said frame only at the edge portions, if the region of said anode that is on the back thereof and between said edge portions is called a rear flat plate region, the rear flat plate region being opposed to said frame with an insulating space being given therebetween, and said rear flat plate region and the region of said frame that is opposed to the rear flat plate region are connected with a stud bolt.

8. The local cleaning system as set forth in claim 7, wherein said discharge electrode is fixed on a conductive discharge electrode supporting member which is provided at the top of said frame, through an insulating sheet, a slot for prevention of creeping discharge being formed in the portion of said frame where said discharge electrode supporting member is fixed, said slot being penetrated from the discharge space for said discharge electrode to the space outside said frame, and being provided in the frame at the middle of said discharge electrode supporting member and said anode.

9. The local cleaning system as set forth in claim 8, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

10. The local cleaning system as set forth in claim 7, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

11. A local cleaning system constructing a shielded space with which movement of air from external space is practically blocked at boundary region, comprising:

a charged air shower unit which forms a curtain-shaped ion wind region, and a local exhaust device receiving the flowing air attributed to the ion wind, at least one said boundary region being comprised of said ion wind region, wherein said charged air shower unit comprises an ion wind blowing direction adjusting mechanism for changing the direction of blow of said ion wind, and wherein said discharge electrode is fixed on a conductive discharge electrode supporting member which is provided at the top of said frame, through an insulating sheet, a slot for prevention of creeping discharge being formed in the portion of said frame where said discharge electrode supporting member is fixed, said slot being penetrated from the discharge space for said discharge electrode to the space outside said frame, and being provided in the frame at the middle of said discharge electrode supporting member and said anode.

12. The local cleaning system as set forth in claim 11, wherein said charged air shower unit and said local exhaust device are disposed such that dirt and dust, microorganisms, odor constituents, and other foreign matters in the air are involved in said ion wind generated by the charged air shower unit, and led to the local exhaust device for exhaust.

* * * * *